US005776882A

United States Patent [19]

Vasudevan

[11] Patent Number: 5,776,882

[45] Date of Patent: Jul. 7, 1998

[54] ISOTROPIC LIQUIDS INCORPORATING HYDROPHOBICALLY MODIFIED POLAR POLYMERS WITH HIGH RATIOS OF HYDROPHILE TO HYDROPHOBE

[75] Inventor: Tirucherai Varahan Vasudevan, West Orange, N.J.

[73] Assignee: Lever Brothers Compay, Division of Conopco, Inc., New York, N.Y.

[21] Appl. No.: 782,185

[22] Filed: Jan. 14, 1997

[51] Int. Cl.[6] ..... C11D 3/22; C11D 1/72; C11D 3/37; C11D 1/83

[52] U.S. Cl. ..... 510/434; 510/421; 510/422; 510/423; 510/424; 510/470; 510/472; 510/473; 510/474; 510/476; 510/477; 510/479; 510/417; 510/433; 510/501; 510/502

[58] Field of Search ..... 510/421, 422, 510/423, 424, 470, 472, 473, 474, 476, 477, 479, 417, 433, 501, 502, 439; 252/239

[56] References Cited

U.S. PATENT DOCUMENTS

| | | | |
|---|---|---|---|
| 4,663,071 | 5/1987 | Bush et al. | 252/174.19 |
| 4,755,327 | 7/1988 | Bernarducci et al. | 252/547 |
| 4,759,868 | 7/1988 | Clarke | 252/170 |
| 4,908,150 | 3/1990 | Hessel et al. | 252/174.12 |
| 5,066,749 | 11/1991 | Leighton et al. | 526/271 |
| 5,073,274 | 12/1991 | Caswell | 252/543 |
| 5,147,576 | 9/1992 | Montague et al. | 252/174 |
| 5,174,927 | 12/1992 | Honsa | 252/543 |
| 5,304,323 | 4/1994 | Arai et al. | 252/299.5 |
| 5,620,952 | 4/1997 | Fu et al. | 510/350 |
| 5,719,117 | 2/1998 | Falk et al. | 510/475 |
| 5,723,434 | 3/1998 | Falk et al. | 510/475 |

FOREIGN PATENT DOCUMENTS

| | | |
|---|---|---|
| 487262 | 5/1992 | European Pat. Off. . |
| 530708 | 3/1993 | European Pat. Off. . |
| 662511 | 7/1995 | European Pat. Off. . |
| 691398 | 1/1996 | European Pat. Off. . |
| 732394 | 9/1996 | European Pat. Off. . |
| 95/31528 | 11/1995 | WIPO . |

OTHER PUBLICATIONS

Bagger–Jorgensen, H., et al., "Phase Behavior of a Nonionic Microemulsion upon Addition of Hydrophobically Modified Polyelectrolyte", Langmuir, 11(6), 1934–1941, Jun. 1995.

*Primary Examiner*—Douglas J. McGinty
*Attorney, Agent, or Firm*—Ronald A. Koatz

[57] ABSTRACT

The present invention relates to isotropic liquids in which hydrophobically modified polar polymers having much higher ratios of hydrophile:hydrophobe than previously possible can be incorporated into the compositions. The compositions comprise greater than 17% to 85% surfactant and rate of hydrophile to hydrophobe on the polymers is greater than 7:1, preferably greater than 20:1, preferably 25:1 and up and most preferably no upper limit.

8 Claims, No Drawings

ISOTROPIC LIQUIDS INCORPORATING HYDROPHOBICALLY MODIFIED POLAR POLYMERS WITH HIGH RATIOS OF HYDROPHILE TO HYDROPHOBE

FIELD OF THE INVENTION

The present invention relates to "isotropic" (non-structured) detergent compositions comprising hydrophobically modified polar polymers (HMPP), e.g., hydrophobically modified anionic and nonionic polymers. Specifically, through manipulation of the isotropic surfactant compositions, it is possible to incorporate HMPPs having much higher ratio of hydrophile to hydrophobe than previously possible with or without use of hydrotropes.

BACKGROUND OF THE INVENTION

The liquid detergent art may be broken down into those detergents in which all components of the liquid system are dissolved into one single liquid phase (e.g., the isotropic liquids); and those which contain sufficient surfactant and/or electrolyte to form a lamellar droplet comprising "onion" type layers dispersed in an electrolyte medium which is capable of suspending undissolved particles in the liquid. These latter liquids are also known as so-called duotropic or structured liquids.

One problem in the structured liquid art has been to find a balance between the stability of the composition and the desirable viscosity of the composition. The viscosity is dependent on volume fraction of liquid occupied by the lamellar droplets. While increasing volume fraction is beneficial from a stability point of view, it also creates higher viscosity which may be undesirable from the point of view of dispensing as well as dispersion in the washing machine.

U.S. Pat. No. 5,147,576 to Montague et al., where the interrelation between surfactants, electrolytes, volume fraction etc. is discussed (and which hereby is incorporated by reference into the subject application), relates to novel deflocculating polymers which allow incorporation of more surfactants and/or electrolytes while still maintaining a stable, low viscosity product.

The polymers of the Montague et al. reference comprise a hydrophilic backbone which is generally a linear, branched or highly cross-linked molecular composition containing one or more types of hydrophilic monomer units; and hydrophobic side chains, for example, selected from the group consisting of siloxanes, saturated or unsaturated alkyl and hydrophobic alkoxy groups, aryl and aryl-alkyl groups, and mixtures thereof.

These polymers were later used in isotropic aqueous liquids but as noted below (see discussion of U.S. Ser. No. 08/591,789 to Falk) the ratio of hydrophile to hydrophobe have to be below certain amounts.

Use of HMPP (i.e., polymers with hydrophilic backbones and hydrophobic side chains) is also mentioned in U.S. Pat. No. 4,759,868 to Clarke. Clarke is limited to high nonionic surfactant compositions and does not teach or suggest that specific surfactant systems are required to solubilize hydrophobically modified polar polymer.

U.S. Ser. No. 08/591,789 to Falk et al. does teach use of hydrophobically modified polymers in detergent compositions such as those of the invention. In order to incorporate the polymers into the compositions, however, minimum levels of hydrophobic modifications are needed. Thus, the ratio of hydrophile to hydrophobe was claimed to be below 20:1 and in reality did not work unless ratio was less than 7:1 (see example 1). Even these ratios (close to 7:1) are accomplished with use of hydrotropes and even with hydrotropes, at ratio above 7:1, compositions were hazy (unstable).

Suddenly and unexpectedly, applicants have found that, with or without the use of hydrotrope, it is possible to stably incorporate HMPP having ratio of hydrophile to hydrophobe above 7:1, preferably above 10:1, more preferably above 20:1, more preferably 25:1 and up, more preferably above 100:1 and most preferably without upper limit, into isotropic solution merely by manipulating the surfactant composition. More specifically, by ensuring that, in a composition comprising a mixture of anionic, nonionic and optionally other surfactants, at least about a 25% of the nonionic component is a sugar surfactant, it is possible to ensure that HMPP having hydrophilic to hydrophobic ratios of 7:1 and above, preferably 20:1 and above, more preferably 25:1 and up, can be stably incorporated into the isotropic liquid surfactant compositions. The greater the percentage of nonionic sugar surfactant as a percentage of total nonionic (up until all the nonionic compound being sugar surfactant), the greater the observed benefit.

While not wishing to be bound by theory, it is believed that inclusion of nonionic sugar surfactant (compared to other nonionic surfactant, for example, alkoxylated nonionic) increases the level of water available in solution for solubilization and therefore allows greater amounts of HMPP, particularly those with more hydrophilic component, to solubilize in the composition.

BRIEF SUMMARY OF THE INVENTION

The present invention relates to isotropic liquid compositions comprising minimum levels of surfactant (i.e., greater than 15%, preferably greater than or equal to 17% total surfactant), the surfactant system comprising a mixture of anionic and nonionic surfactants, wherein the nonionic sugar surfactant (as a percentage of all nonionic surfactant in the surfactant system) comprises at least about 25% of the nonionic, preferably at least 50% of the nonionic.

The use of minimum levels of nonionic sugar surfactant allows stable incorporation of hydrophobically modified polar polymers wherein the ratio of hydrophilic to hydrophobic groups is 7:1 and greater, preferably greater than 20:1, more preferably 25:1 and up, more preferably without upper limit wherein stable incorporation of these polymers is obtained with or without use of hydrotrope. By "stable" incorporation is meant that the HMPP can be solubilized in the compositions. By stable is broadly meant that the compositions do not phase separate over the period of at least a year when measured over a temperature range of −5° C. to 60° C.

DETAILED DESCRIPTION OF INVENTION

The present invention relates to isotropic liquid compositions comprising minimum levels of surfactants and further comprising hydrophobically modified polar polymers (HMPP). More particularly, by insuring that minimum levels (i.e., about 25% and higher) of all nonionic surfactant present is a sugar nonionic, it is possible to incorporate HMPPs wherein the ratio of hydrophilic to hydrophobic group on the HMPPs is greater than 7:1, preferably greater than about 20:1, more preferably 25:1 and up, more preferably without limit. These HMPPs may be incorporated with or without use of hydrotrope.

While not wishing to be bound by theory, it is believed that HMPPs with greater ratio of hydrophilic to hydrophobic group than previously believed possible could be incorporated in the compositions because the use of more sugar nonionics provides greater amounts of water, thereby permitting more hydrophilic groups to solubilize.

The compositions are described in greater detail below:

Detergent Active

The compositions of the invention contain one or more surface active agents selected from the group consisting of anionic, nonionic, cationic, ampholytic and zwifterionic surfactants or mixtures thereof. The preferred surfactant detergents for use in the present invention are mixtures of anionic and nonionic surfactants although it is to be understood that any surfactant may be used alone or in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophilic group, i.e. water solubilizing group such as carboxylate, sulfonate or sulfate group or their corresponding acid form. The anionic surface active agents include the alkali metal (e.g. sodium and potassium) water soluble higher alkyl aryl sulfonates, alkyl sulfonates, alkyl sulfates and the alkyl poly ether sulfates. They may also include fatty acid or fatty acid soaps. One of the preferred groups of anionic surface active agents are the alkali metal, ammonium or alkanolamine salts of higher alkyl aryl sulfonates and alkali metal, ammonium or alkanolamine salts of higher alkyl sulfates. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium, potassium or ethanolamine $C_{10}$ to $C_{16}$ benzene sulfonate, e.g. sodium linear dodecyl benzene sulfonate. The primary and secondary alkyl sulfates can be made by reacting long chain alpha-olefins with sulfites or bisulfites, e.g. sodium bisulfite. The alkyl sulfates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The alkali metal or ethanolamine alkyl aryl sulfonate can be used in an amount of 0 to 70%, preferably 5 to 50% and more preferably 5 to 20% by weight.

The alkali metal or ethanolamine sulfate can be used in admixture with the alkylbenzene sulfonate in an amount of 0 to 70%, preferably 5 to 50% by weight.

Also normal alkyl and branched chain alkyl sulfates (e.g., primary alkyl sulfates) may be used as the anionic component.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The alkali metal higher alkyl poly ethoxy sulfate can be used with the alkylbenzene sulfonate and/or with an alkyl sulfate, in an amount of 0 to 70%, preferably 5 to 50% and more preferably 5 to 20% by weight of entire composition.

Nonionic Surfactant

Part of the surfactant composition, according to the subject invention, must be nonionic surfactant. Generally the nonionic surfactant, whether sugar surfactant or not, should comprise about 10% to 100%, preferably 20% to 50% of the total surfactant composition.

In addition at least 25% of the nonionic surfactant should comprise sugar surfactant (e.g., glycoside surfactant).

Sugar or glycoside surfactants suitable for use in accordance with the present invention include those of the formula:

$$RO—R^1O—_y(Z)_x$$

wherein R is a monovalent organic radical containing from about 6 to about 30 (preferably from about 8 to about 18) carbon atoms ($C_6$ to $C_{30}$ saturated or unsaturated, branched or unbranched alkyl group); $R^1$ is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Alkyl polyglycosides are discussed in the following patents: U.S. Pat. No. 5,573,707 to Cole et al., U.S. Pat. No. 5,562,848 to Wofford et al., U.S. Pat. No. 5,542,950 to Cole et al., WO 96/15305 to Cole et al., U.S. Pat. No. 5,529,122 to Thach, WO 9,533,036 to urfer et al., and DE 4,234,241 to Schmidt. These references are hereby incorporated by reference into the subject application.

Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Another class of sugar based surfactants which can be used include N-alkoxy or N-aryloxy polyhydroxy fatty acid amides discussed in WO 95/07256 to Schiebel et al., WO 92/06071 to Connor et al., and WO 92/06160 to Collins et al. These references are incorporated by reference into the subject application.

Yet another class of sugar based surfactants are sugar esters discussed in GB 2,061,313, GB 2,048,670, EP 20122 and U.S. Pat. No. 4,259,202 to Tanaka et al. These references are again incorporated by reference into the subject application.

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic surfactants are polyalkoxylated lipophiles wherein the desired hydrophile-lipophile balance is obtained from addition of a hydrophilic poly-lower alkoxy group to a lipophilic moiety. A preferred class of nonionic surfactant is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 10 to 15 carbon atoms and which contain about 5 to 9 ethylene oxide groups per mole, e.g. Neodol 25-9 and Neodol 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac by BASF. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol or Neodol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 6 to 9 moles, and the $C_9$ to $C_{11}$ fatty alcohols ethoxylated with about 5–6 moles ethylene oxide.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

If used, cationic generally comprise 0% to 20%, preferably 1–10% by wt. of total composition.

Amphoteric Surfactants

Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate.

Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of active used may vary from 1 to 85% by weight, preferably 2 to 50%, more preferably 5 to 20% by wt. of the composition.

As noted the preferred surfactant systems of the invention are mixtures of anionic and nonionic surfactants.

Builders/Electrolytes

Builders which can be used according to this invention include conventional alkaline detergency builders, inorganic or organic, which should be used at levels from about 0% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, tartrate disuccinate and mixtures thereof (TMS/TDS).

Certain zeolites or aluminosilicates can be used. One such aluminosilicate which is useful in the compositions of the invention is an amorphous water-insoluble hydrated compound of the formula $Na_x(_yAlO_2, SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

One or more enzymes as described in detail below, may optionally be used in the compositions of the invention.

If a lipase is used, the lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism *Chromobacter viscosum* var. lipolyticum NRRL B-3673. This microorganism has been described in Dutch patent specification 154,269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immunodiffusion procedure according to Ouchterlony (Acta. Med. Scan., 133, pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant
day 4: antigen in complete Freund's adjuvant
day 32: antigen in incomplete Freund's adjuvant
day 60: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in this embodiment of the invention. Typical examples thereof are the lipase ex *Pseudomonas fluorescens* IAM 1057 available from Amano Pharmaceutical Co., Nagoya, Japan, under the trade-name Amano-P lipase, the lipase ex *Pseudomonas fragi* FERM P 1339 (available under the trade-name Amano-B), the lipase ex *Pseudomonas nitroreducens* var. lipolyticum FERM P1338, the lipase ex *Pseudomonas sp.* available under the trade-name Amano CES, the lipase ex *Pseudomonas cepacia*, lipases ex *Chromobacter viscosum*, e.g. *Chromobacter viscosum* var. lipolyticum NRRL B-3673, commercially available from Toyo Jozo Co., Tagata, Japan; and further Chromobacter viscosum lipases from U.S. Biochemical Corp. USA and Diosynth Co., The Netherlands, and lipases ex *Pseudomonas gladioli*.

An example of a fungal lipase as defined above is the lipase ex *Humicola lanuginosa*, available from Amano under the tradename Amano CE; the lipase ex *Humicola lanuginosa* as described in the aforesaid European Patent Application 0,258,068 (NOVO), as well as the lipase obtained by cloning the gene from *Humicola lanuginosa* and expressing this gene in *Aspergillus oryzae*, commercially available from NOVO industri A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1–10, more preferably 0.5–7, most preferably 1–2 g/liter.

A Lipase Unit (LU) is that amount of lipase which produces 1/μmol of titratable fatty acid per minute in a pH stat under the following conditions: temperature 30° C.; pH=9.0; substrate is an emulsion of 3.3 wt. % of olive oil and 3.3% gum arabic, in the presence of 13 mmol/1 $Ca^{2+}$ and 20 mmol/1 NaCl in 5 mmol/1 Tris-buffer.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B. licheniformis*. Examples of suitable commercially available proteases are Alcalase, Savinase, Esperase, all of NOVO Industri a/S; Maxatase and Maxacal of Gist-Brocades; Kazusase of Showa Denko; BPN and BPN' proteases; Optimase from Solvay and so on. The amount of proteolytic enzyme, included in the composition, ranges from 0.05–50,000 GU/mg, preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way by specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention. One example of an engineered commercially available enzyme is Durazym® from Novo.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used in propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system is the pH jump system such as is taught in U.S. Pat. No. 5,089,163 to Aronson et al., hereby incorporated by reference into the subject application.

Optional Ingredients

In addition to the enzymes mentioned above, a number of other optional ingredients may be used.

Alkalinity buffers which may be added to the compositions of the invention include monoethanolamine, triethanolamine, borax and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401, 413 to Marriott and British Patent No. 461,221 to Marriott and Guam.

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Optical brighteners for cotton, polyamide and polyester fabrics can be used. Suitable optical brighteners include Tinopal LMS-X, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicon compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, soil release polymers and cationic softening agents may be used.

Hydrophobically Modified Polar Polymer

The polymer of the invention is one which, as noted above, has previously been used in structured (i.e., lamellar) compositions such as those described in U.S. Pat. No. 5,147,576 to Montague et al., hereby incorporated by reference into the subject application.

In general, the polymer comprises a "backbone" component which is a monomer (single monomer) as discussed below and a "tail" portion which is a second monomer which is hydrophobic in nature (e.g., lauryl methacrylate or styrene).

The hydrophilic backbone generally is a linear, branched or highly cross-linked molecular composition containing one type of relatively hydrophobic monomer unit wherein the monomer is preferably sufficiently soluble to form at least a 1% by weight solution when dissolved in water. The only limitation to the structure of the hydrophilic backbone is that a polymer corresponding to the hydrophilic backbone made from the backbone monomeric constituents is relatively water soluble (solubility in water at ambient temperature and at pH of 3.0 to 12.5 is preferably more than 1 g/l). The hydrophilic backbone is also preferably predominantly linear, e.g., the main chain of backbone constitutes at least 50% by weight, preferably more than 75%, most preferably more than 90% by weight of the polymer.

The hydrophilic backbone is composed of one monomer unit selected from a variety of units available for polymer preparation and linked by any chemical links including

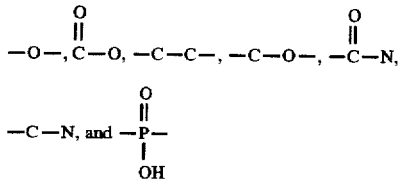

The "tail" group comprises a monomer unit comprising hydrophobic side chains which are incorporated in the "tail" monomer. The polymer is made by copolymerizing hydrophobic monomers (tail group comprising hydrophobic groups) and the hydrophilic monomer making up the backbone. The hydrophobic side chains preferably include those which when isolated from their linkage are relatively water insoluble, i.e., preferably less than 1 g/l, more preferred less than 0.5 g/l, most preferred less than 0.1 g/l of the hydrophobic monomers, will dissolve in water at ambient temperature at pH of 3.0 to 12.5.

Preferably, the hydrophobic moieties are selected from siloxanes, saturated and unsaturated alkyl chains, e.g., having from 5 to 24 carbons, preferably 6 to 18, most preferred 8 to 16 carbons, and are optionally bonded to hydrophilic backbone via an alkoxylene or polyalkoxylene linkage, for example a polyethoxy, polypropoxy, or butyloxy (or mixtures of the same) linkage having from 1 to 50 alkoxylene groups. Alternatively, the hydrophobic side chain can be composed of relatively hydrophobic alkoxy groups, for example, butylene oxide and/or propylene oxide, in the absence of alkyl or alkenyl groups. Another preferred hydrophobic group include styrene.

Monomer units which make up the hydrophilic backbone include:

(1) unsaturated, preferably mono-unsaturated, $C_{1-6}$ acids, ethers, alcohols, aldehydes, ketones or esters such as monomers of acrylic acid, methacrylic acid, maleic acid, vinyl-methyl ether, vinyl sulphonate or vinylalcohol obtained by hydrolysis of vinyl acetate, acrolein;

(2) cyclic units, unsaturated or comprising other groups capable of forming inter-monomer linkages, such as saccharides and glucosides, alkoxy units and maleic anhydride;

(3) glycerol or other saturated polyalcohols.

Monomeric units comprising both the hydrophilic backbone and hydrophobic side chain may be substituted with groups such as amino, amine, amide, sulphonate, sulphate, phosphonate, phosphate, hydroxy, carboxyl and oxide groups.

The hydrophilic backbone is composed of one unit. The backbone may also contain small amounts of relatively hydrophilic units such as those derived from polymers having a solubility of less than 1 g/l in water provided the overall solubility of the polymer meets the requirements discussed above. Examples include polyvinyl acetate or polymethyl methacrylate.

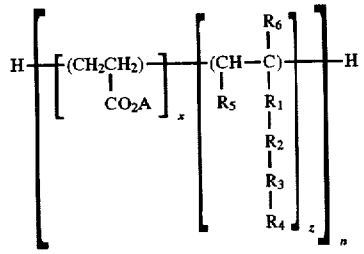

wherein z is 1;

x:z (i.e., hydrophilic backbone to hydrophobic tail) is greater than 7:1, preferably greater than 20:1, more preferably 25:1 and up, more preferably without upper limit;

in which the monomer units may be in random order; and n is at least 1:

$R_1$ represents —CO—O—, —O—, —O—CO—, —$CH_2$—, —CO—NH— or is absent;

$R_2$ represents from 1 to 50 independently selected alkyleneoxy groups preferably ethylene oxide or propylene oxide groups, or is absent, provided that when $R_3$ is absent and $R_4$ represents hydrogen or contains no more than 4 carbon atoms, then $R_2$ must contain an alkyleneoxy group with at least 3 carbon atoms;

$R_3$ represents a phenylene linkage, or is absent;

$R_4$ represents hydrogen or a $C_{1-24}$ alkyl or $C_{2-24}$ alkenyl group, with the provisos a) when $R_1$ represents—O—CO—, $R_2$ and $R_3$ must be absent and $R_4$ must contain at least 5 carbon atoms;

b) when $R_2$ is absent, $R_4$ is not hydrogen and when $R_3$ is absent, then $R_4$ must contain at least 5 carbon atoms;

$R_5$ represents hydrogen or a group of formula —COOA;

$R_6$ represents hydrogen or C1–4 alkyl; and A is independently selected from hydrogen, alkali metals, alkaline earth metals, ammonium and amine bases and $C_{1-4}$.

Alternatively, the

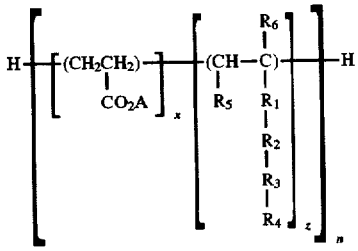

group (defined by z) can be substituted benzene group such as, for example styrene.

The present invention is directed to the observation that, when polymers such as those described above (known as deflocculating or decoupling polymers in the "structured liquid" art) are used in isotropic liquids and further when there is a criticality of hydrophilic groups to hydrophobic groups, the liquids are far more stable (i.e., they do not phase separate and become hazy, but rather stay clear) than if these required or preferred variables had not been met.

More particularly, when the molar ratio of hydrophilic to hydrophobic monomer is greater than 7:1, preferably greater than 20:1, more preferably 25:1 and up, an isotropic liquid which would otherwise be unstable (less clear) hazy becomes clear.

The polymer should be used in an amount comprising 0.1 to 10% by wt., preferably 0.25% to 5% by wt. of the composition, more preferably 0.25 to 2% by wt.

Other optional ingredients which may be used are hydrotropes.

In general, addition of hydrotropes helps to incorporate higher levels of surfactants into isotropic liquid detergents than would otherwise be possible due to phase separation of surfactants from the aqueous phase. Hydrotropes also allow a change in the proportions of different types of surfactants, namely anionic, nonionic, cationic and zwitterionic, without encountering the problem of phase separation. Thus, they increase the formulation flexibility. Hydrotropes function through either of the following mechanisms: i) they increase the solubility of the surfactant in the aqueous phase by changing the solvent power of the aqueous phase; short chain alcohols such as ethanol, isopropanol and also glycerol and propylene glycol are examples in this class and ii) they prevent formation of liquid crystalline phases of surfactants by disrupting the packing of the hydrocarbon chains of the surfactants in the micelles; alkali metal salts of alkyl aryl sulfonates such as xylene sulfonate, cumene sulfonate and alkyl aryl disulfonates such as DOWFAX® family of hydrotropes marketed by Dow Chemicals are examples in this class.

Preferred hydrotropes in the compositions of the present invention are polyols, which may also act as enzyme stabilizers, such as propylene glycol, ethylene glycol, glycerol, sorbitol, mannitol and glucose.

The following examples are intended to clarify the invention further and are not intended to limit the invention in any way.

All percentages are intended to be percentages by weight, unless stated otherwise.

Materials

Surfactants: Linear alkylbenzene sulfonic acid (LAS acid) was purchased from Vista Chemicals; alcohol ethoxy sulfate (AES; Neodol 25-3S) and ethoxylated alcohols (Neodol 25-9) were purchased from Shell Chemicals. Sugar surfactant alkylpolyglycoside (APG) of different chain lengths were supplied by Henkel Corp. Coco-lactobionamide was prepared in house. The lactobionamides can be prepared as described in U.S. Pat. No. 5,389,279 to Au et al.

Polymers: Hydrophobically modified polyacrylates (HMPAA) (decoupling polymers) of different molecular weights and containing different ratios of acrylate (AA; hydrophile) to laurylmethacrylate (LMA; hydrophobe) were synthesized and characterized at National Starch and Chemicals.

Other Reagents: Sorbitol was supplied as a 70 wt. % aqueous solution by ICI Americas,sodium borate 10 aq., sodium citrate 2 aq. and glycerol were purchased from Fisher Scientific.

Methods: The formulations were prepared by adding to water, sodium citrate, sorbitol, borate, hydrotrope and sodium hydroxide in a beaker and stirred at 35°–50° C. until the solution became clear. This was followed by the addition of LAS acid and Neodol 25-9. The mixture was then cooled at 25° C. and the desired amount of Neodol 25-3S (59% AES) was added. Required amount of polymer was then added to the base formulation at room temperature (18°–23° C.).

COMPARATIVE

Solubility of HMPAA (AA: LMA, that is hydrophile to hydrophobe ratio, 25:1) in ethoxylated alcohol compositions

| Composition of Base Formulation | | |
|---|---|---|
| Component | Wt. %. | Remarks |
| LAS | 2.7 to 8.0 | ↑ |
| Ethoxylated alcohol, $EO_9$ | 2.7 to 8.0 | Surfactant |
| AES | 4.6 to 14.0 | ↓ |
| Total surfactants | 10.0 to 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 2.5 | Sequestrant |
| Ethanol | 1.1 to 3.3 | Solvent present in AES raw material |
| Minors (optional) | 2.0 | Enzymes, fluorescer, perfume, etc. |
| HMPAA (AA:LMA 25:1) | 0.17 to 0.83 | Anti-redep. polymer |
| Water | to 100 | |

Note:
i) AES to ethanol ratio (w/w) was constant at 4.2
ii) LAS:$EO_9$:AES (w/w) was constant at 5:3:3

| HMPAA concentration | Total Surfactant concentration wt. | | | | |
|---|---|---|---|---|---|
| wt. % | 10.0 | 15.0 | 20.0 | 25.0 | 30.0 |
| 0.17 | Insoluble | Soluble | Insoluble | Insoluble | Insoluble |
| 0.33 | Insoluble | Soluble | Insoluble | Insoluble | Insoluble |
| 0.83 | Insoluble | Soluble | Insoluble | Insoluble | Insoluble |

This example shows that in formulations containing ethoxylated alcohol, $EO_9$, as the nonionic surfactant, the hydrophobically modified polyacrylate (HMPAA) with a hydrophilic to hydrophobe ratio (AA:LMA) of 25:1 is not soluble in compositions containing higher than 20 wt. % surfactant.

While the polymers are soluble in lower surfactant concentration (i.e., 15%), this is of no value in typical detergent compositions where surfactants comprise 17% to 85%, preferably 20% to 50% of the composition. Solubility at 15% surfactant concentration is believed related to the fact that there is more available water in the composition. At 10%, there is also more water (i.e, at less surfactant concentrations, there is more water), but it is believed that there is not sufficient micelles.

COMPARATIVE & EXAMPLE 1 & 2

Solubility of HMPAA (AA: LMA 25:1) in compositions containing ethoxylated alcohol or sugar-based surfactant as the nonionic component.

| Composition of Base Formulation | | |
|---|---|---|
| Component | Wt. %. | Remarks |
| LAS | 8.0 | ↑ |
| Nonionic surfactant* | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 2.5 | Sequestrant |
| Ethanol | 3.3 | Solvent present in AES raw material |
| Minors (optional) | 2.0 | Enzymes, fluorescer, perfume, etc. |
| HMPAA (AA:LMA 25:1) | 0.17 to 0.83 | Anti-redep. polymer |
| Water | to 100 | |

*$EO_9$ or sugar surfactant

| | Comparative | Example 1 | Example 2 |
|---|---|---|---|
| | Nonionic Surfactant | | |
| HMPAA concn. wt. % | $EO_9$ Actives | APG ($C_{12}$–$C_{14}$) | Coco-lactobionamide |
| 0.17 | Insoluble | Soluble | Soluble |
| 0.33 | Insoluble | Soluble | Soluble |
| 0.83 | Insoluble | Soluble | Soluble |

This example shows that HMPAA is insoluble in formulations containing ethoxylated alcohol, $EO_9$ as the nonionic surfactant but is soluble in formulations containing sugar-based surfactant such as APG or coco-lactobionamide as the nonionic surfactant. In this case 8% $EO_9$ nonionic was replaced by 8% sugar surfactant.

More specifically, here, even at 30% surfactant level, it is possible to incorporate HMPAA with ratios of 25:1. Without wishing to be bound by theory, it is believed that, though there is less available water (e.g., more surfactant in $EO_9$ formulations), the use of sugar surfactant provides greater water availability.

EXAMPLE 3

Ratio of APG ($C_{12}$–$C_{14}$) to $EO_9$ on the solubility of HMPAA

| Composition of Base Formulation | | |
|---|---|---|
| Component | Wt. %. | Remarks |
| LAS | 8.0 | ↑ |
| Nonionic surfactant* | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 2.5 | Sequestrant |
| Ethanol | 3.3 | Solvent present in AES raw material |
| Minors (optional) | 2.0 | Enzymes, fluorescer, perfume, etc. |
| HMPAA (AA:LMA 25:1) | 0.17 to 0.83 | Anti-redep. polymer |
| Water | to 100 | |

*$EO_9$, APG or mixtures thereof

-continued

| HMPAA | $EO_9$:APG ($C_{12}$–$C_{14}$) | | | | |
|---|---|---|---|---|---|
| concn. wt. % | 1:0 | 3:1 | 1:1 | 1:3 | 0:1 |
| 0.17 | Insoluble | Soluble | Soluble | Soluble | Soluble |
| 0.33 | Insoluble | Soluble | Soluble | Soluble | Soluble |
| 0.83 | Insoluble | Insoluble | Soluble | Soluble | Soluble |

This example shows that it is not necessary to completely replace $EO_9$ with the sugar surfactant, APG, to achieve solubilization of the HMPAA. Even a partial replacement of $EO_9$ with the sugar surfactant is adequate. Thus, even at ratios of 3:1 $EO_9$ to APG, polymer is soluble at 0.17 and 0.33 levels. At higher levels of polymer, the lower availability of water, it is believed, makes solubility of polymer more difficult (i.e., 3:1 ratio using 0.83 wt. % polymer is insoluble). When more APG is used, solubility is readily achieved at all concentrations.

EXAMPLE 4

Molar ratio of hydrophilic (AA) to hydrophobic (LMA) groups on HMPAA solubility

| Composition of Base Formulation | | |
|---|---|---|
| Component | Wt. %. | Remarks |
| LAS | 8.0 | ↑ |
| APG ($C_{12}$–$C_{14}$) | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 2.5 | Sequestrant |
| Ethanol | 3.3 | Solvent present in AES raw material |
| Minors (optional) | 2.0 | Enzymes, fluorescer, perfume, etc. |
| HMPAA | 0.17 to 0.83 | Anti-redep. polymer |
| Water | to 100 | |

| HMPAA concn. | AA:LMA (Molar ratio) | | | |
|---|---|---|---|---|
| wt. % | 115:1 | 25:1 | 18:1 | 6:1 |
| 0.17 | Soluble | Soluble | Soluble | Soluble |
| 0.33 | Soluble | Soluble | Soluble | Soluble |
| 0.83 | Soluble | Soluble | Soluble | Soluble |

This example shows that HMPAA having a molar ratio of hydrophilic (AA) to hydrophobic (LMA) group as high as 115:1 can be solubilized in formulations containing APG as the nonionic surfactant. HMPAA having AA:LMA molar ratio no higher than 6:1 was soluble in formulations containing $EO_9$ as the nonionic surfactant (see applicants copending 08/591,789 to Falk et al.), and at ratios above this, solubilization became more and more difficult. In general, the art has shown that the higher the value of AA relative to LMA, the more difficult it is to solubilize the polymer in liquid detergent compositions. Thus, the ability to solubilize at much higher ratios merely by manipulation of nonionic surfactant was truly unexpected.

EXAMPLE 5

Effect of surfactant composition on HMPAA (AA:LMA 25:1) solubility

| Composition of Base Formulation | | |
|---|---|---|
| Component | Wt. %. | Remarks |
| LAS | 0.0–12.0 | ↑ |
| APG ($C_{12}$–$C_{14}$) | 8.0–15.0 | Surfactant |
| AES | 8.0–22.5 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 2.5 | Sequestrant |
| Ethanol | 1.15 to 3.3 | Solvent present in AES raw material |
| Minors (optional) | 2.0 | Enzymes, fluorescer, perfume, etc. |
| HMPAA (AA:LMA 25:1) | 0.17 to 0.83 | Anti-redep. polymer |
| Water | to 100 | |

Note:
i) AES to ethanol ratio (w/w) was constant at 4.2

| HMPAA | LAS:APG($C_{12}$–$C_{14}$):AES | | | | |
|---|---|---|---|---|---|
| concn. wt. % | 5:3:3 | 4:3:3 | 3:3:5 | 0::1:1 | 0:1:3 |
| 0.17 | Soluble | Soluble | Soluble | Soluble | Soluble |
| 0.33 | Soluble | Soluble | Soluble | Soluble | Soluble |
| 0.83 | Soluble | Soluble | Soluble | Soluble | Soluble |

This example shows that HMPAA is soluble in wide variety of surfactant compositions containing the sugar surfactant, APG.

EXAMPLE 6

Effect of citrate concentration on the solubility of HMPAA

| Composition of Base Formulation | | |
|---|---|---|
| Component | Wt. %. | Remarks |
| LAS | 8.0 | ↑ |
| APG ($C_{12}$–$C_{14}$) | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 0–10.0 | Sequestrant |
| Ethanol | 3.3 | Solvent present in AES raw material |
| Minors (optional) | 2.0 | Enzymes, fluorescer, perfume, etc. |
| HMPAA (AA:LMA 25:1) | 0.5 | Anti-redep. polymer |
| Water | to 100 | |

| Sod. citrate 2 aq. Wt. % | HMPAA Solubility |
|---|---|
| 0.0 | Soluble |
| 2.5 | Soluble |

-continued

| | |
|---|---|
| 7.5 | Soluble |
| 10.0 | Soluble |

This example shows that in the range tested, there is no effect of citrate concentration on HMPAA solubility.

EXAMPLE 7

Effect of different chain lengths of APG on HMPAA solubility

| Composition of Base Formulation | | |
|---|---|---|
| Component | Wt. %. | Remarks |
| LAS | 8.0 | ↑ |
| APG | 8.0 | Surfactant |
| AES | 14.0 | ↓ |
| Total surfactants | 30.0 | |
| Sodium borate 10 aq. | 4.0 | Enzyme stabilizer |
| Sorbitol | 4.5 | ↑ |
| Glycerol | 2.7 | Enzyme stabilizer & hydrotrope |
| Propylene glycol | 4.5 | ↓ |
| Sodium citrate 2 aq. | 0–10.0 | Sequestrant |
| Ethanol | 3.3 | Solvent present in AES raw material |
| Minors (optional) | 2.0 | Enzymes, fluorescer, perfume, etc. |
| HMPAA (AA:LMA 25:1) | 0.5 | Anti-redep. polymer |
| Water | to 100 | |

| APG Chainlength | HMPAA Solubility |
|---|---|
| $C_8$–$C_{10}$ | Soluble |
| $C_{12}$–$C_{14}$ | Soluble |

This example shows that in the range tested, there is no effect of APG carbon chain length on HMPAA solubility.

We claim:

1. An isotropic liquid detergent composition comprising:

(a) greater than about 17% by wt. to 85% by wt. of a surfactant selected from the group consisting of anionic, nonionic, cationic, amphoteric and zwitterionic surfactants and mixtures thereof;

wherein nonionic comprises at least 10% by wt. of the total surfactant composition; and wherein at least 25% of total nonionic comprises a sugar surfactant;

(b) 0 to 25% electrolyte;

(c) 0.1 to 10% by wt. polymer having (1) a hydrophilic backbone comprising monomer units selected from:

(a) one ethylenically unsaturated hydrophilic monomers selected from the group consisting of unsaturated $C_{1-6}$ acids, ethers, alcohols, aldehydes, ketones or esters; and/or (b) one polymerizable hydrophilic cyclic monomer units; and/or (c) one or more non-ethylenically unsaturated polymerizable hydrophilic monomers selected from the group consisting of glycerol and other polyhydric alcohols;

wherein said polymer is optionally substituted with one or more amino, amine amide, sulphonate, sulphate, phosphonate, hydroxy, carboxyl or oxide groups to specify one monomer only; and (2) a tail comprising a monomer comprising a hydrophobic pendant group;

said polymer having a MW of 1,000 to 20,000;

wherein molar ratio of backbone hydrophilic group to pendant hydrophobic group is greater than 20:1; and (d) 0 to 20% hydrotrope.

2. A composition according to claim 1, wherein polymer of (c) has formula:

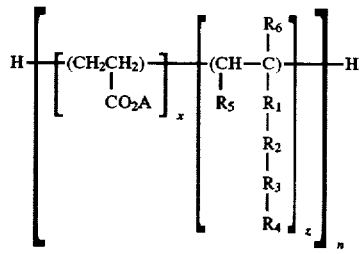

wherein z is 1;

x:z (i.e., hydrophilic backbone to hydrophobic tail) is greater than 20:1, in which the monomer units may be in random order; and n is at least 1:

$R_1$ represents —CO—O—, —O—, —O—CO—, —$CH_2$—, —CO—NH— or is absent;

$R_2$ represents from 1 to 50 independently selected alkyleneoxy groups preferably ethylene oxide or propylene oxide groups, or is absent, provided that when $R_3$ is absent and $R_4$ represents hydrogen or contains no more than 4 carbon atoms, then $R_2$ must contain an alkyleneoxy group with at least 3 carbon atoms;

$R_3$ represents a phenylene linkage, or is absent;

$R_4$ represents hydrogen or a $C_{1-24}$ alkyl or $C_{2-24}$ alkenyl group, with the provisos a) when $R_1$ represents —CO—, $R_2$ and $R_3$ must be absent and $R_4$ must contain at least 5 carbon atoms;

b) when $R_2$ is absent, $R_4$ is not hydrogen and when $R_3$ is absent, then $R_4$ must contain at least 5 carbon atoms;

$R_5$ represents hydrogen or a group of formula —COOA;

$R_6$ represents hydrogen or C1–4 alkyl; and A is independently selected from hydrogen, alkali metals, alkaline earth metals, ammonium and amine bases and $C_{1-4}$.

3. A composition according to claim 1, wherein ratio is 25:1 and greater.

4. A composition according to claim 1, wherein ratio is greater than or equal to 50:1.

5. A composition according to claim 1, wherein total composition comprises about 20% to 50% total surfactant.

6. A composition according to claim 1, wherein surfactant is mixture of anionic and nonionic surfactants.

7. A composition according to claim 1, wherein the sugar surfactant is selected from the group consisting of:

(a) sugar or glycoside surfactants having formula:

$$ROR'O_y(Z)_x$$

wherein R is monovalent $C_6$ to $C_{30}$ organic radical;

R' is divalent hydrocarbon radical of about 2 to 4 carbons;

O is oxygen;

y is a number of average value of 0 to 12;

z is derived from 5 or 6 carbon containing reducing sugar; and x is average 1 to about 10;

(b) alkyl polyglycosides;

(c) polyhydroxy fatty acid amides; and (d) aldobionamides.

8. A composition according to claim 2, wherein ratio of x:z is 25:1 and up.

* * * * *